US006186689B1

(12) United States Patent
Sheffler et al.

(10) Patent No.: US 6,186,689 B1
(45) Date of Patent: Feb. 13, 2001

(54) COSMETIC CONTAINER HAVING A CLEAN CORKAGE INSERT

(75) Inventors: Robert J. Sheffler, Morganville, NJ (US); Charles Chang, 55 Westview Ave., Wayne, NJ (US) 07404

(73) Assignee: Charles Chang, Wayne, NJ (US)

( * ) Notice: Under 35 U.S.C. 154(b), the term of this patent shall be extended for 0 days.

(21) Appl. No.: 09/133,673

(22) Filed: Aug. 13, 1998

(51) Int. Cl.[7] ..... A46B 11/00
(52) U.S. Cl. ..... 401/129; 401/122
(58) Field of Search ..... 401/129, 122, 401/126, 128, 121, 118; 132/218

(56) References Cited

U.S. PATENT DOCUMENTS 3,280,421 * 10/1966 Davidson ..... 401/122
4,761,088 * 8/1988 Zubek ..... 401/129 X
4,930,919 * 6/1990 Gueret ..... 401/129 X
5,242,232 * 9/1993 Kuhn ..... 401/122

FOREIGN PATENT DOCUMENTS

1436613 * 3/1966 (FR) ..... 401/122
8802608 * 4/1988 (WO) ..... 401/122

* cited by examiner

*Primary Examiner*—David J. Walczak
(74) *Attorney, Agent, or Firm*—Richard A. Joel, Esq

(57) ABSTRACT

A cosmetic container comprises an insert which is preassembled to a brush by means of an undercut ring located beneath a brush flange and cooperating with an undercut recess in the throat of the insert. The insert walls are held by friction in the container and anchored externally to the container by a ring which extends peripherally from the threaded container wall. An undercut in the insert external flange engages the ring to complete the anchor. The insert is molded from polymer that repels the cosmetic product owing to molecular polarity. The insert functions as a sealing mechanism and a means to keep product from reaching the top of the container or on the container threads. The insert walls may also be shaped as a liquid inhibitor to retard flow from the container if the bottle is tipped over inadvertently.

2 Claims, 9 Drawing Sheets

COSMETIC CONTAINER HAVING A CLEAN CORKAGE INSERT

BACKGROUND OF THE INVENTION

This invention deals with color cosmetic liquid products that are traditionally applied with a brush, sponge or foamed mitt utilized with a rod or stem. These products may include nail coatings, liquid eyeliner, lip-liner or other facial products. The invention is designed to serve multiple functions as a sealing mechanism and as a means to keep product from locating on the top of a bottle finish or on the continuous threads of the bottle opening.

Existing cosmetic packages are subject to product migration onto surfaces where they can cause problems of inadvertent staining of ones clothes or other personal property. There is also the chance of product dry-out acting as an adhesive which binds the closure to the container, complicating subsequent use owing to the difficulty in cap removal. The function of the insert which is the subject of this invention, is to provide the means to maintain a product-free environment at the land seal and without, and at the same time, enhance the containment and sealing of the liquid product within the bottle.

An additional advantage offered by this invention is the pre-assembly feature of the insert and the applicator brush or rod. Accordingly, the filler and assembler of the primary container which provides the packaging for the product need not place the insert and the applicator in their proper orientation via separate steps. A single placement of the pre-assembled components will accomplish the proper registration.

In optional embodiments, the insert may be part of the bottle neck and may include inwardly projecting walls which act as a flow inhibitor. The lip of the container is also designed to be the smallest practical and to provide the minimum surface for the product which may be deposited thereon. This minimizes the amount of product which might reach the threads.

The prior art includes U.S. Pat. No. 5,190,389 to Vasas which discloses a rod and applicator brush for applying cosmetics. The main feature of this patent concerns a wiper for removing excess product from the brush. U.S. Pat. No. 3,896,823 to Spatz discloses an applicator for coloring eyelashes which includes a wiper for removing excess mascara from the applicator member.

Dahm U.S. Pat. No. 4,784,505 discloses a container with a stripper which prevents excess product from depositing on the applicator. Also of interest are U.S. Pat. No. 4,403,624 to Montgomery and U.S. Pat. No. 4,841,996 to Gueret.

The prior art does not disclose the unique insert of this invention used in conjunction with a cosmetic container or bottle.

SUMMARY OF THE INVENTION

This invention relates to cosmetic containers and particularly to containers having a unique insert which serves multiple functions, namely sealing and preventing the product from locating on top of the container finish or the container threads.

The insert is held in the neck of the bottle or container by friction and mechanical attachment to a recessed ring about the thread root of a continuous thread finish. The insert is molded from a polymer that repels the cosmetic product by means of molecular polarity. Typical of these plastics are the polyolefins, fluoroplastics, nylons, acetals, polyesters, epoxy resins and elastomeric polyesters. The insert design also physically relocates the aperture at the top of the container a distance above the threaded neck, making the continuous threads less susceptible to product coating or contamination. Additionally, the insert provides multiple seals which prevent leakage or loss of solvents from the container.

More specifically, the container includes an insert which is preassembled to a brush by means of an undercut ring located beneath a brush flange and cooperating with an undercut recess in the neck of the container. The downwardly extending walls of the insert are held by friction in the container neck and the insert is anchored externally to the container by a ring which extends outwardly from the threaded container. The interaction between the external surface of the insert and the container's inner wall, together with the interlocking components at the finish exterior wall is more formidable than the preassembly lock between the insert and the brush. The insert is thus tightly locked in the neck of the container. The radial edge on the brush provides a means for wiping away excess product from the brush.

Alternatively, the insert may not be preassembled to the brush and it can be separate from a bottle neck or part of a one-piece neck. Further, the lip of the bottle or container opening is reduced in surface area to limit the product which may be deposited thereon and thus prevent liquid from reaching the threads.

Accordingly, it is an object of this invention to provide a new and improved insert for a container opening.

Another object of this invention is to provide a new and improved insert for sealing a cosmetic container.

A further object of this invention is to provide a new and improved sealed top for a cosmetic bottle having an elongated neck.

A still further object of this invention is to provide a new and improved cosmetic container which includes a primary seal of a valve type where the cone of the brush plugs the bottle corkage and a secondary seal or land seal between the brush flange and the lip of the container.

Another object of this invention is to provide a new and improved insert for a cosmetic container which is preassembled to a brush and which engages the container opening to maintain a product free environment at the land seal and without, while at the same time enhancing the containment and sealing of the liquid product within the container.

A more specific object of this invention is to provide a plastic insert having a pre-assembled brush mounted thereto which fits into the neck of a container to effect a functional seal, said insert also having an undercut flange on the upper portion thereof which engages the threaded outer ring on the container for sealing purposes.

BRIEF DESCRIPTION OF THE DRAWINGS

The above and other objects and advantages of this invention may be more clearly seen when viewed in conjunction with the accompanying drawings wherein.

DETAILED DESCRIPTION OF THE INVENTION

Figure 1:
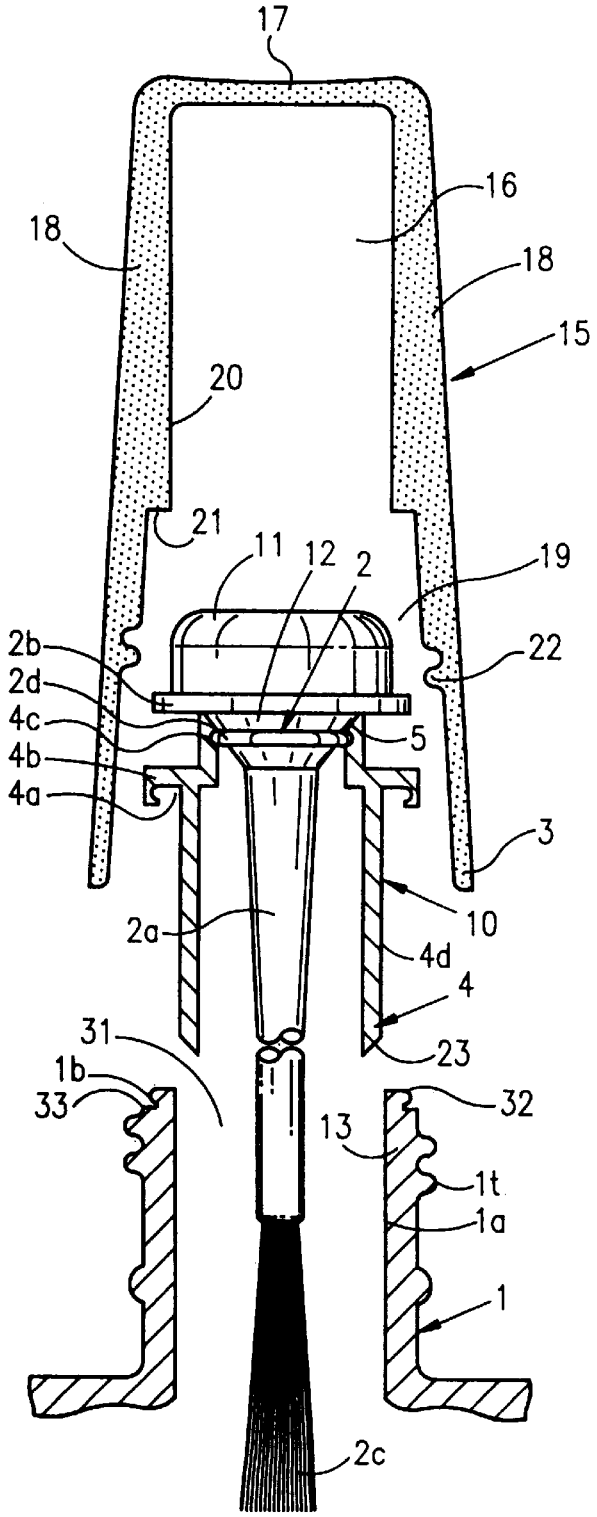
FIG. 1 is an exploded cross-sectional view of the invention.

Referring to FIG. 1 of the drawings, the invention comprises an insert 4 used to seal a container 1 normally containing liquid cosmetics such as nail enamel, liquid eyeliner or lip-liner. The insert 4 includes an upper flange 4*b* extending outwardly from the upper portion of a hollow cylinder 10. The flange 4*b* also extends inwardly from the cylinder 10 with its elongated walls 4*d* to an upwardly extending cylindrical portion having a narrow top edge 5 at the end thereof and having an undercut recess 4*c* on its upper interior wall. The flange 4*b* also includes an undercut recess 4*a* on the outer lower surface thereof to connect to the container 1. The cylinder 10 has an outwardly tapered edge 23 at the lower end thereof to facilitate entry into a container 1.

A brush 2 is pre-assembled to the insert 4 which saves considerable effort. Accordingly, the filler and assembler of the primary container which provides the packaging for the product need not place the insert 4 and the applicator 2 in their proper orientation via separate steps. A single placement of the pre-assembled components will accomplish proper orientation. The brush 2 includes a top gripping portion 11, a circular liner or intermediate circular flange 2*b* extending outwardly from the base of the top portion 11 and a downwardly tapered section or walls 12 leading to an undercut ring 2*d* which engages the undercut recess 4*c* in the insert 4 to secure the parts 2 and 4 together, that is, the brush 2 and insert 4. A sealing ring (not shown) may be located between the liner 2*b* and the flanges 4*b* to act as a stopper in the container opening 31.

The brush 2 further includes a stem 2*a* extending axially within the insert 4 and having a tufted applicator 2*c* projecting outwardly from the end thereof into the container 1. The stem 2*a* and brush 2*c* are an integral unit which may be pre-assembled and then the entire brush is pre-assembled to the insert 4. Alternatively, the insert 4 may not be preassembled to the brush 2 and the insert 4 may also be separate from the bottle neck 13 or part of a one-piece neck.

The container 1 includes an open neck portion 13 having an inner wall 1*a* which is frictionally engaged by the outer wall 4*d* of the insert 4. The neck portion 13 comprises an outer surface having threads 1*t* and an undercut ring 1*b* at the upper edge thereof. The undercut ring 1*b* engages the undercut portion 4*a* in the insert flange 4*b* to secure the insert 4 and brush 2 assembly to the container 1 by engagement with the ring 1*b*. The lip surface 32 is designed to be as small as possible since this is the place where product tends to be deposited. The smaller the surface area, the less product will get on lip surface 32. The main purpose is to prevent product from reaching the threads 1*t* by a two level cascade design involving surfaces 32 and 33. The surface 33 is sufficiently lower than 32 so that the brush 2 does not touch the surface 33 when being removed from and reinserted into container 1.

The container also includes a cap 15 having an interior recess 16 and outwardly sloped sides 18 extending downwardly from the top 17. The recessed interior includes a lower portion having an enlarged recess 19 to accommodate the top 11. The interior walls 20 include a ledge 21 which engages the liner 2*b* and a threaded portion 22 which engages the exterior threads 1*t* on the container neck 13.

Figure 4A:
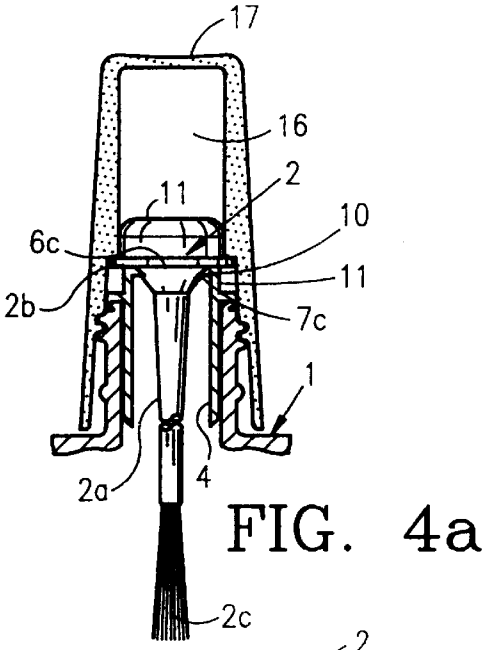
FIGS. 2*a*, 3*a* and 4*a* are respective cross-sectional views of the foregoing insert embodiments showing the entire bottle top assembly.
Figure 4:
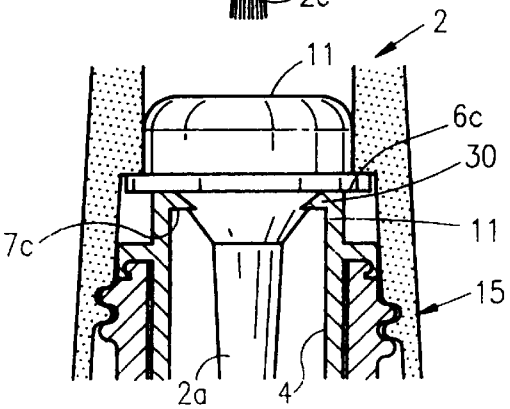
FIGS. 2, 3 and 4 are enlarged cross-sectional views of the insert showing various embodiments thereof.
Figure 3A:
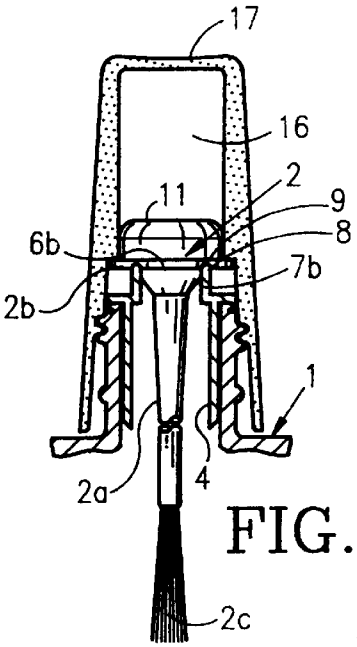
Figure 3:
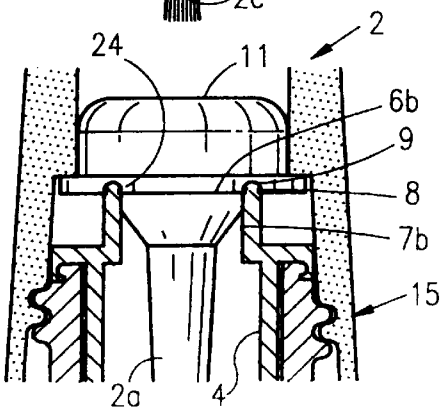
Figure 2A:
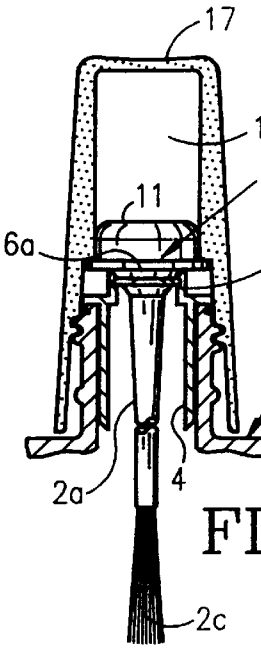
Figure 2:
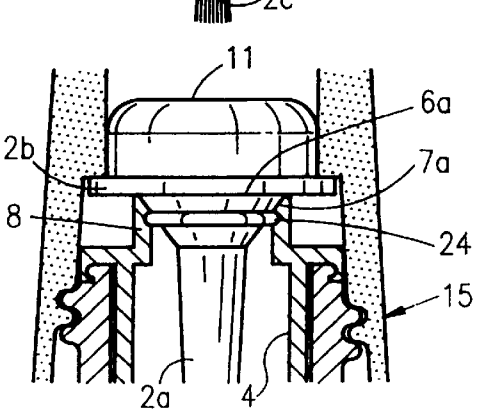

FIGS. 2, 3 and 4 illustrate various embodiments of the invention while FIGS. 2*a*, 3*a* and 4*a* are respectively enlarged cross-sectional views of the insert embodiment. FIGS. 2 and 2*a* disclose a land seal 6*a* and valve seal 7*a*. The brush 2 and insert 4 assembly are attached in FIGS. 3 and 3*a* to the container 1 by means of a cooperating male extension 8 at the top of the insert 4, snapping it into undercuts 9 in the brush flange or liner 2*b*. In FIGS. 3 and 3*a*, there is a land seal 6*b* and a radial valve seal with the projection 8 extending into recesses 24.

FIGS. 4 and 4*a* illustrates an embodiment wherein there is a horizontal member 30 in the form of a dish at the top edge of the insert 4. This provides a means for joining the insert 4 and the brush 2 before package assembly and a horizontal doctoring edge 11 to remove excess liquid product. There is also a land seal 6*c* and a valve seal 7*c*.

Figure 5B:
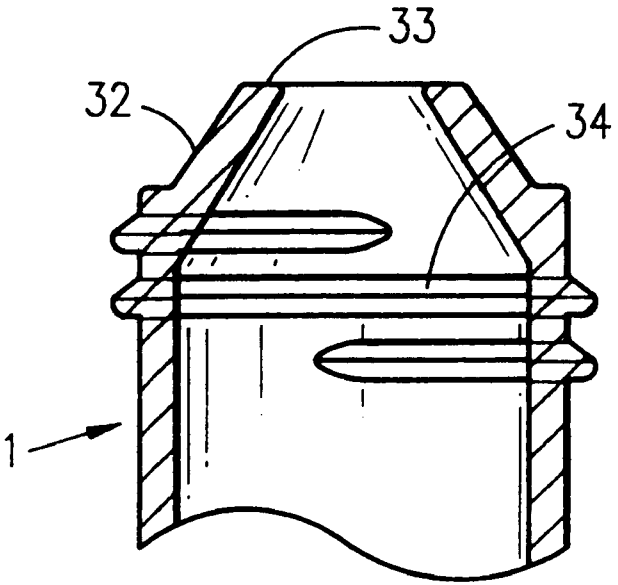
FIGS. 5*a* and 5*b* depict an alternate embodiment of the invention wherein the features of the invention are embodied in a container design.
Figure 5A:
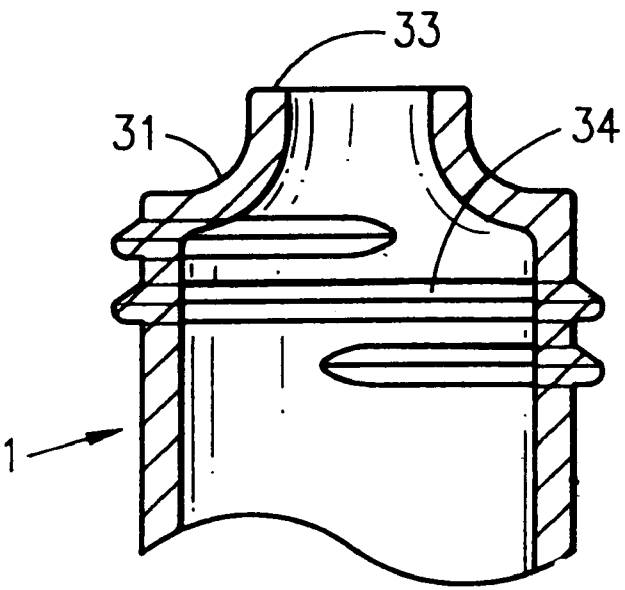

A further embodiment is illustrated in FIGS. 5*a* and 5*b* wherein the bottles 1 are shaped at 40*a* and 40*b* to simulate the contours and functions of the inserts 4. These designs provide an effective means for maintaining the clear separation of the land seal 33 from the continuous threads 34.

To summarize, the insert 4 and brush 2 may be snap fitted together. The undercut snap together feature of recess 4*c* and liner 2*d* is of lesser magnitude than the force between the insert 4 and the container 1. Thus, the brush 2 separates from the insert 4 when the consumer uses the brush 2. The primary function of the invention is to provide a dispensing surface 32 above the threads 1*t* and located inwardly so that the liquid product such as nail enamel does not come in contact with the threads 1*t* particularly when the brush is wiped to remove excess product. The invention has 2 seals, a primary valve type seal where the lower conical surface 5 plugs the container opening 31 and a secondary seal or land seal between the brush flange or liner 2*b* and the lip 32 of the container.

A purpose of the invention is to prevent the neck 13 of cosmetic containers 1 from becoming contaminated with cosmetic product from the container 1. In theory, these ends can be attained by making the surface area of the top lip 32 as narrow as possible. In some instances, however, it may be necessary to have a thick lip 32 and design accommodations will have to be made. Another design criteria is to keep the top lip 32 and cap roof 12 from contact. The distance between the lip 32 and the cap inside wall 17 should also be as large as possible for best results. On the other hand, the lip 32 and wall 17 can be relatively close in particular designs.

Figure 7:
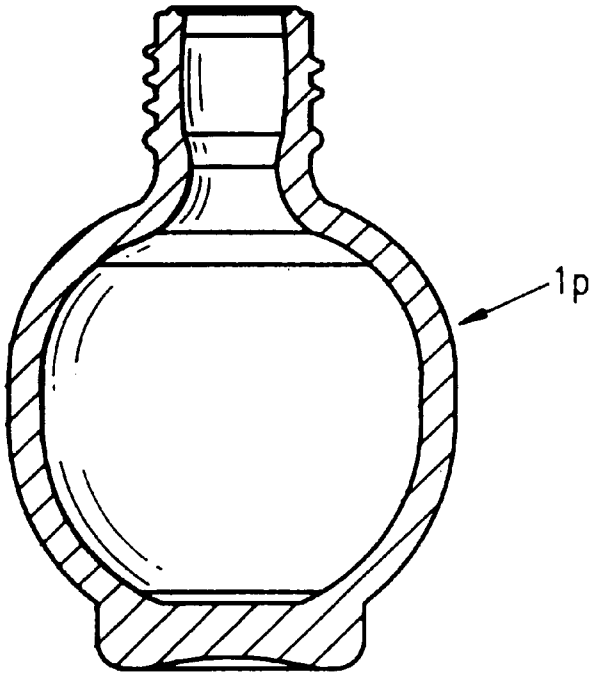
FIG. 7 (PRIOR ART)
FIG. 7 is a cross-sectional view of the bottle of FIG. 6 which represents the prior art.

Referring now to FIG. 7*a*, a clean neck 13 is achieved by keeping the top lip 32 narrow to carry less product which may be transferred to the neck 13. A wider mouth opening is depicted in FIG. 7*b* to permit the ready insertion of brushes 2*c* back into the container 1 without scraping any product onto the top rim 32. The container 1 is also solid on the inside of the land area.

A narrow lip width is defined as a width which is narrower than the combined bottle neck 13 and wiper wall thickness. This automatically increases the mouth opening. On the other hand, if a large opening 31 is desired, the top rim 32 is simply extended.

Figure 8:
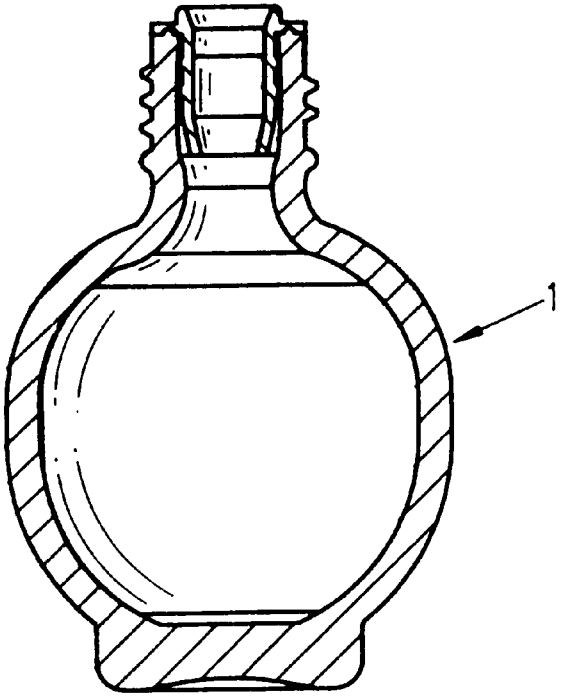
FIG. 8 is a cross-sectional view of the invention showing the bottle and assembled insert of FIG. 6.

In another embodiment shown in FIG. 8*a*, the plug 70 is extended outwardly and includes threads 71 on the outer surface 72 thereof. A larger opening results.

Analyzing the drawback, the bottle neck 13 gets coated with product when the brush 2*c* leaves a residue 73 on the lip 32 (see FIG. 8*b*). When the cap 15 is replaced, it compresses the residue 73 and spreads the product forward and to the sides (see FIG. 8*c*). A portion leaks onto the outside of the bottle neck 13 where it is sandwiched between the neck 13 and the cap 15. The product is carried forward with the cap 15.

To solve the above problem, the rim width can be reduced so that only a small amount of residue is deposited thereon. The lip 32 is also kept away from the cap inside wall. More desirable, the cap 15 is not permitted to come into contact with the lip 32 so that contact is not made with the residue 73.

Ideally, the land surface 32 is kept distant from the cap wall 20 and away from the cap roof 17. As shown in FIG. 9*a*, a seal can be formed by friction rings 81 or by a regular land seal as shown in FIG. 9*b*. For products which require a large spiral wound brush such as mascara or a large applicator such as lip gloss, a wide opening 31 is desirable in order to guide the brush/applicator back into the container 1 without scrapping any product off from the brush 2 onto the surface. FIG. 9*c* illustrates a wide opening. The residue 73 left on the lip 32 will dry out and can be scraped off easily without contaminating the threads 1*c*.

The first key feature of this application is the reduction of the amount of product residue left on the surface of the rim by reducing the surface area for product contamination in a cosmetic container. Then the contamination area is separated from the clean surrounding area by elevating the contamination area upward and is protect by the larger diameter of the clean surrounding area so that the cap's inner surface will not be in contact with the residue. The insert or plug 4 is designed for the above purpose and not for the purpose of wiping the stem 2*a*.

Figure 6:
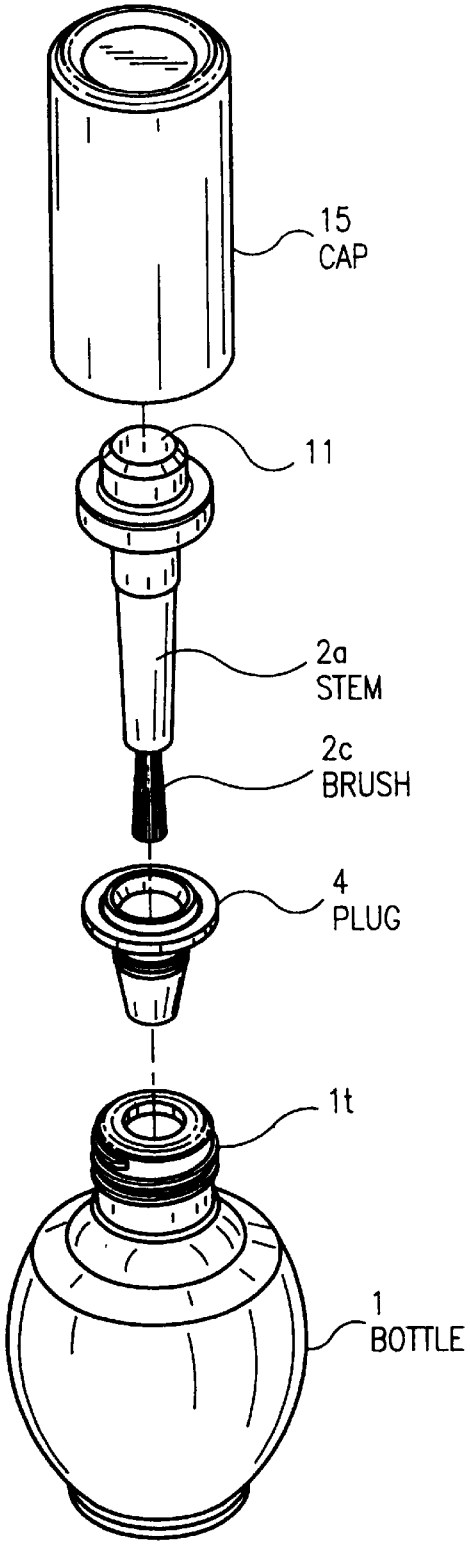
FIG. 6 is an exploded perspective view of the invention.

To clarify the invention, FIG. 6 is an exploded perspective view of FIG. 1 showing the principal parts of the invention. A direct comparison with the prior art may be achieved by comparing the cross-sectional view of the conventional container or bottle 1 of FIG. 7 with applicant's bottle 1 in FIG. 8.

Figure 10:
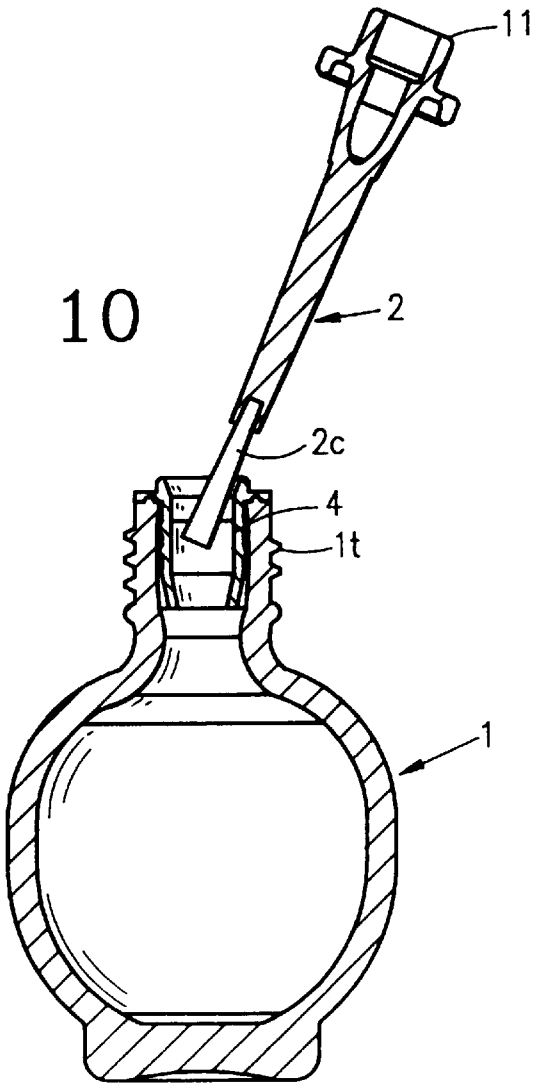
FIG. 10 depicts a coated brush being removed from the bottle of FIG. 8.
Figure 9:
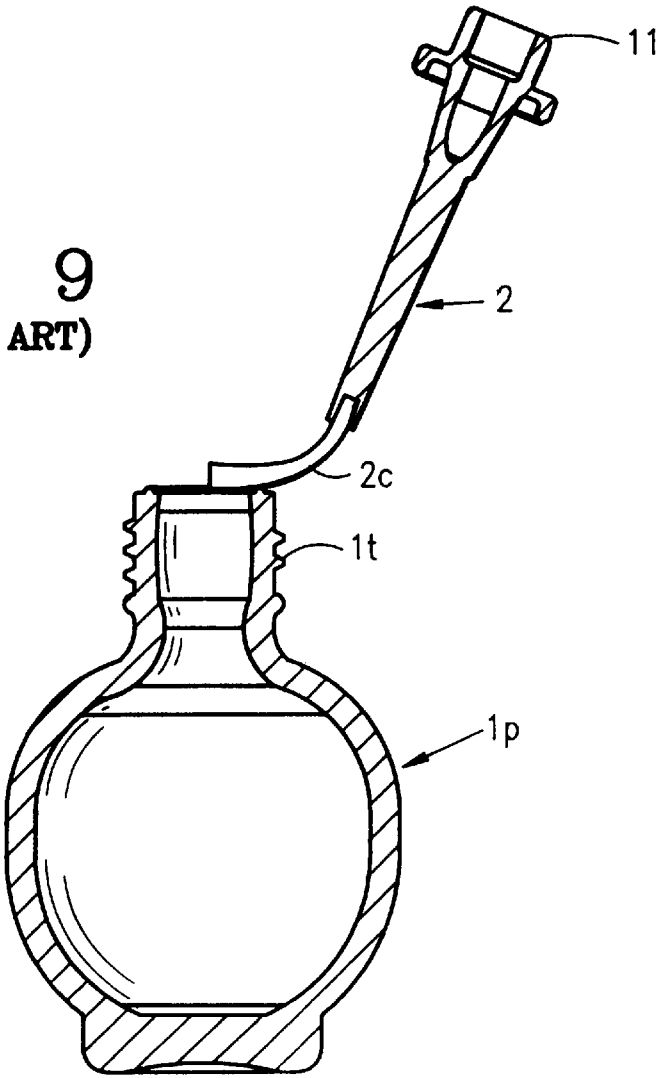
FIG. 9 (PRIOR ART)
FIG. 9 depicts the prior art with a coated brush being removed from the bottle of FIG. 7.

FIG. 9 illustrates a coated brush 2 being removed from the prior art bottle while FIG. 10 illustrates the coated brush 2 being withdrawn from the new bottle 1 with the insert or plug 4.

Figure 12:
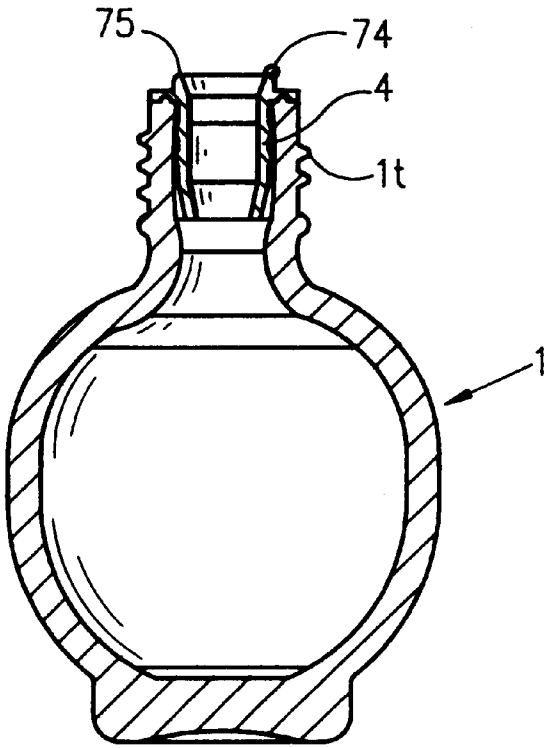
FIG. 12 shows the residue left on the rim of the bottle in FIG. 10.
Figure 11:
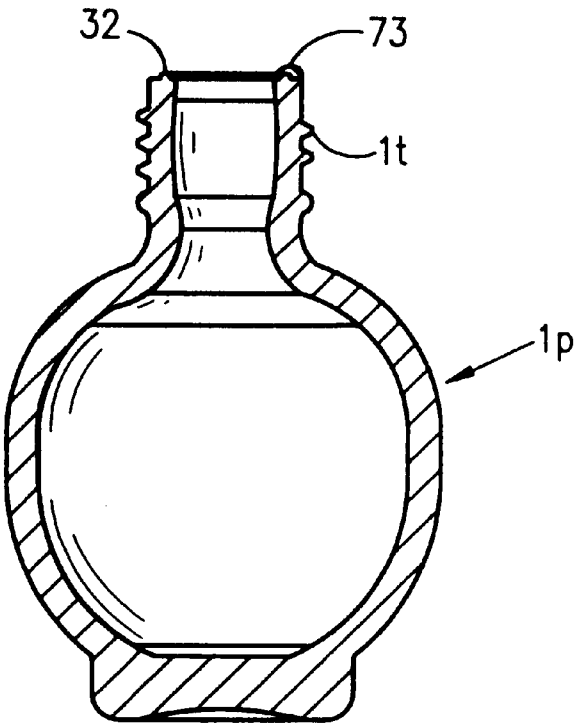
FIG. 11 (PRIOR ART)
FIG. 11 shows the residue left on the rim of the bottle in FIG. 9.

FIG. 11 shows the residue 73 left on the lip 32 of the bottle 1*p* in FIG. 9 by the coated brush 2 while FIG. 12 shows the residue 74 left on the rim 75 of the insert 4 in FIG. 10.

Figure 13:
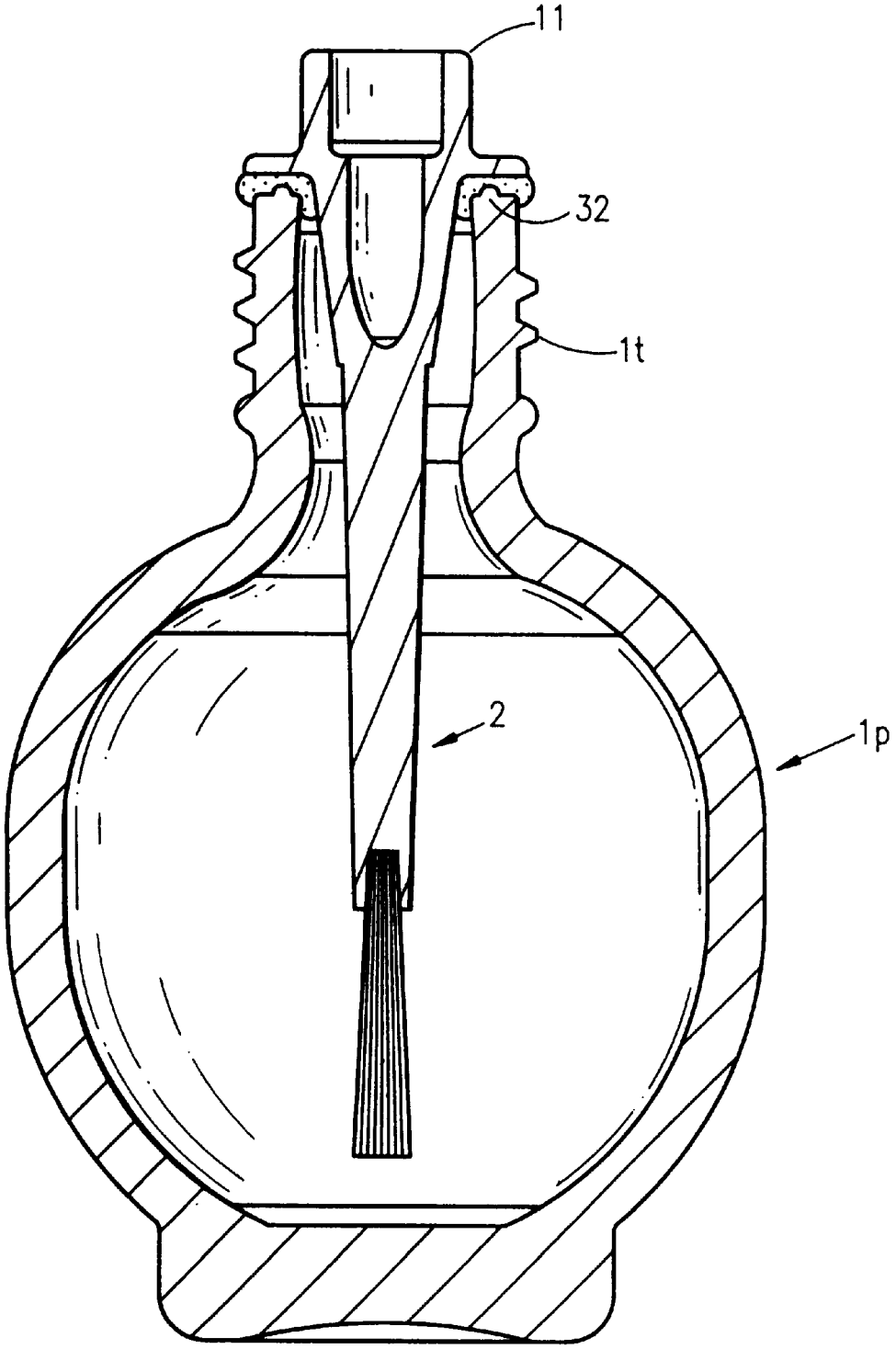
FIG. 13 (PRIOR ART)
FIG. 13 shows the residue being squeezed away from the rim in FIG. 11 by the brush; and, FIG. 14 shows the residue being squeezed away from the insert rim in FIG. 12 by the brush.
Figure 14:
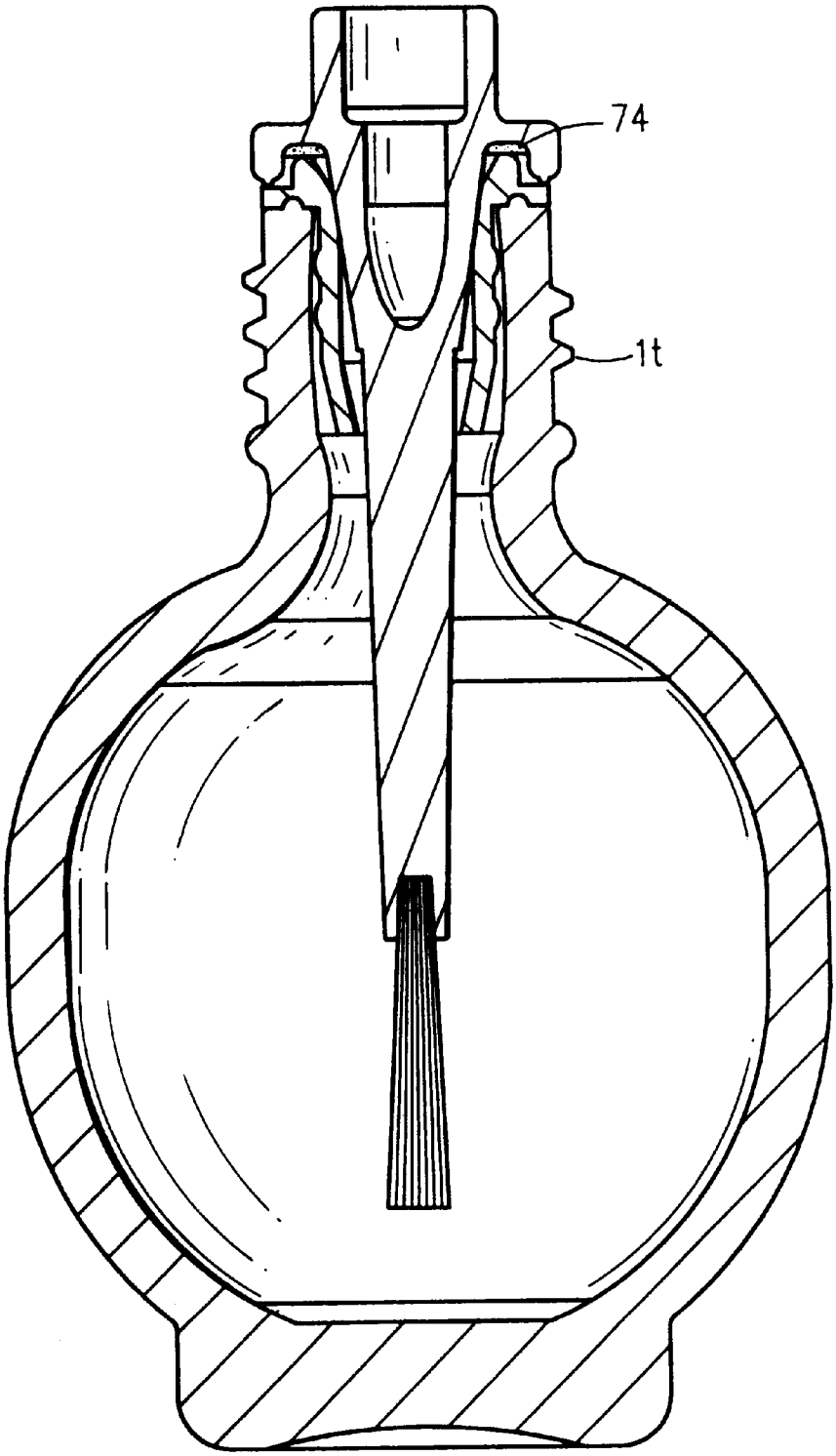

FIG. 13 shows the residual, product being squeezed away from the rim area 32 to the inside and outside of the rim 32. Note how the residue 73 flows down to the threads 1*t* on the exterior of the bottle 1*p* after repeated use. On the other hand, the small amount of residue 74 in FIG. 14 is squeezed away from the narrow insert rim 75 to the inside and outside surface of the elevated rim 75 in the new design. This lesser amount of residue 74 is a great advantage since the residue 74 which does flow on the outside of the rim 72 does not reach the threads 1*t*. Instead, the outside flow is trapped on the flange 2*b* away from the threads 1*t*. The larger diameter of threads 1*t* prevents the cap's inner surface from getting in contact with the residue.

While the invention has been explained by a detailed description of certain specific embodiments, it is understood that various modifications and substitutions can be made in any of them within the scope of the appended claims which are intended also to include equivalents of such embodiments.

What is claimed is:

1. A cosmetic container for liquid products comprising:

a hollow portion have a top, a neck extending upwardly from the top forming a cylindrical opening into the hollow container portion said neck having an upper edge having an undercut ring and surrounding said opening and outer threads on said neck, a brush comprising a top gripping portion, an intermediate circular flange extending laterally outward from the top gripping portion and having a downwardly tapered wall extending downwardly from the flange, and an elongated stern extending downwardly from the downwardly tapered wall and having bristles mounted thereto at the end of said stem, an insert comprising an elongated wall forming a hollow member having an upper end and a lower end wherein the upper end includes a narrow top edge for engagement with the brush intermediate circular flange and a flange having an undercut recess thereon and extending outwardly from the elongated wall to engage the undercut ring on the upper edge of the container neck and the lower end comprises a downwardly extending wall which engages the cylindrical container neck portion and which tapers inwardly at a lower end thereof to facilitate entry into the neck portion;

a hollow cap comprising a top with a downwardly extending wall having internal threads thereon to engage the outer threads on the neck portion; and, wherein the liquid product is deposited as residue on the narrow top edge of the insert during use of the brush said narrow top edge and said flange preventing the residue from reaching the threads on the neck portion.

2. A cosmetic container for liquid products in accordance with claim 1, wherein:

the insert comprises a molded polymer that repels cosmetic owing to molecular polarity.

* * * * *